US005524647A

United States Patent [19]

Brackmann

[11] Patent Number: 5,524,647

[45] Date of Patent: Jun. 11, 1996

[54] CONTROL OF CIGARETTE SMOKE CHEMISTRY

[75] Inventor: Warren A. Brackmann, Collins, Mo.

[73] Assignee: Rothmans, Benson & Hedges, Inc., North York, Canada

[21] Appl. No.: 457,238

[22] Filed: Jun. 1, 1995

Related U.S. Application Data

[62] Division of Ser. No. 185,860, Jul. 7, 1994.

[30] Foreign Application Priority Data

Aug. 8, 1991 [GB] United Kingdom ..... 9117118

[51] Int. Cl.[6] ..... A24D 3/04

[52] U.S. Cl. ..... 131/339; 131/341; 131/344

[58] Field of Search ..... 131/339, 340, 131/341, 344

[56] References Cited

U.S. PATENT DOCUMENTS

| | | | |
|---|---|---|---|
| 3,882,877 | 5/1975 | Brackmann et al. . | |
| 4,022,222 | 5/1977 | Berger | 131/344 X |
| 4,357,950 | 11/1982 | Berger et al. | 131/344 X |
| 4,787,401 | 11/1988 | Brackmann et al. | 131/364 X |
| 4,793,367 | 12/1988 | Brackmann | 131/364 X |
| 4,972,853 | 11/1990 | Brackmann et al. | 131/339 X |
| 5,190,061 | 3/1993 | Brackman et al. | 131/331 X |

FOREIGN PATENT DOCUMENTS

| | | |
|---|---|---|
| 0226368 | 6/1987 | European Pat. Off. . |
| 0364253 | 4/1990 | European Pat. Off. . |
| 0408354 | 1/1991 | European Pat. Off. . |

OTHER PUBLICATIONS

Leffingwell et al, Tobacco Flavoring for Smoking Products, R. J. Reynolds Co. 1972, p. 4.

Garner, The Production of Tobacco, 1951, pp. 442-443.

*Primary Examiner* Jennifer Bahr
*Attorney, Agent, or Firm* Sim & McBurney

[57] ABSTRACT

A high level of flavour can be provided in cigarette smoke at a low tar level while providing a more uniform delivery of flavour and tar as the cigarette is smoked, in comparison to a conventional cigarette. A tobacco blend is employed using higher-than-normal quantities of tobacco from the upper levels of a tobacco plant, to provide an initial high flavour-to-tar ratio. A flavour reset technique is employed to attenuate the flavour strength of the smoke to the smoker, so that such attenuated but acceptable flavour level is provided at a much lower tar level. In addition, latter puff manipulation of the tobacco smoke is effected to decrease the flavour level and tar produced in the latter puffs of smoking to provide a more uniform flavour delivery. Filter element structures and other specific elements to achieve these results are described.

9 Claims, 4 Drawing Sheets

FLAV. STRENGTH

TAR

NICOTINE

CO

CONTROL OF CIGARETTE SMOKE CHEMISTRY

This is a divisional of application Ser. No. 08/185,860 filed Jul. 7, 1994.

FIELD OF INVENTION

The present invention relates to controlling the chemistry of cigarette smoke entering a smoker's mouth, to provide a desirable combination of high sensory appeal and low tar.

BACKGROUND TO THE INVENTION

Tar is a component of cigarette smoke considered undesirable and attempts are continually being made to deliver lower quantities of tar to the smoker. Conventional procedures have included increased filtration and ventilation. However, only a certain level of filtration can be achieved with conventional filters before the pressure drop across the filter becomes unacceptably high.

Similarly, only a certain level of ventilation can be achieved before the cigarette smoke takes on an unacceptable "airy" taste. Generally, "low tar" cigarettes tend to be unpopular with smokers, since they fail to deliver sufficient flavour in the smoke to satisfy the smoker.

Another problem encountered by smokers is the increasing levels of tar and flavour delivered by a cigarette as it is smoked, sometimes reaching unacceptable levels in the latter puffs.

SUMMARY OF INVENTION

The present invention achieves a unique result, in providing the high flavour level associated with popular brands of cigarettes but at a significantly lower tar level. For example, a cigarette in accordance with the invention may be provided which delivers 6.7 mg of tar while providing the flavour of a conventional 14.0 mg tar cigarette. In addition, the present invention is able to provide a more uniform delivery of flavour and tar as the cigarette is smoked, as compared with a conventional cigarette.

In accordance with this aspect of the present invention, there is provided a novel cigarette, which comprises a tobacco filler rod comprising a higher-than-normal proportion of tobacco derived from leaves from the upper levels of tobacco plants, such as to provide a higher flavour-to-tar ratio in the smoke produced upon smoking the cigarette rod; a tobacco smoke filter element through which tobacco smoke passes from the burning tobacco filler rod upon smoking of the cigarette and contructed to attenuate the flavour level of smoke delivered to the smoker, while maintaining approximately the same flavour-to-tar ratio; and means associated with at least one of the filler rod and filter element for decreasing the level of both flavour and tar in the cigarette smoke during later stages of smoking of the filler rod.

GENERAL DESCRIPTION OF INVENTION

Figure 1A:
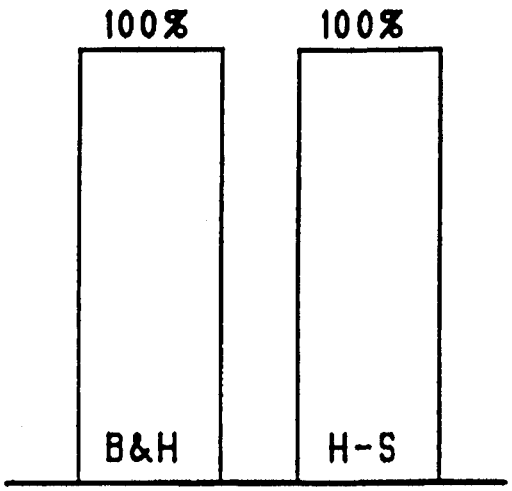
FIGS. 1A, 1B, 1C and 1D are bar graph presentations of smoking test results.
Figure 1B:
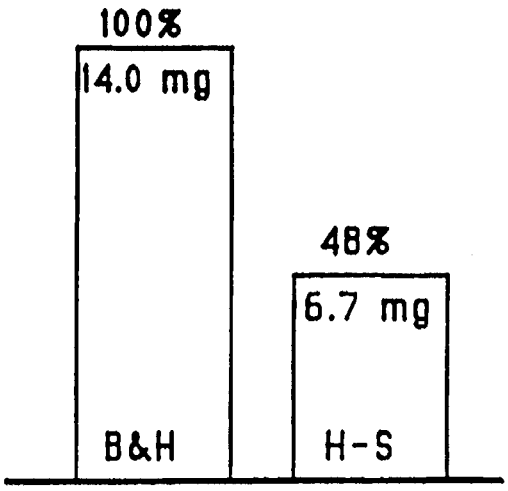
Figure 1C:
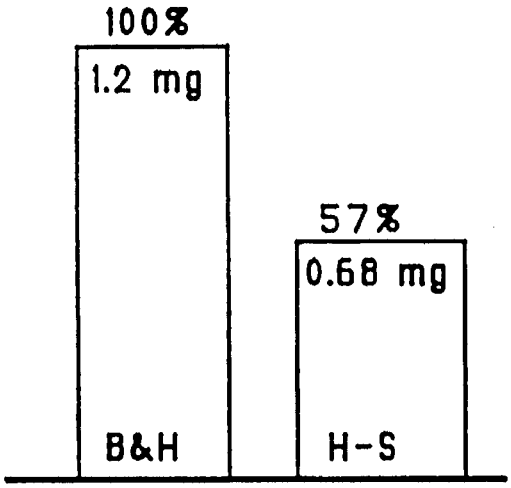
Figure 1D:
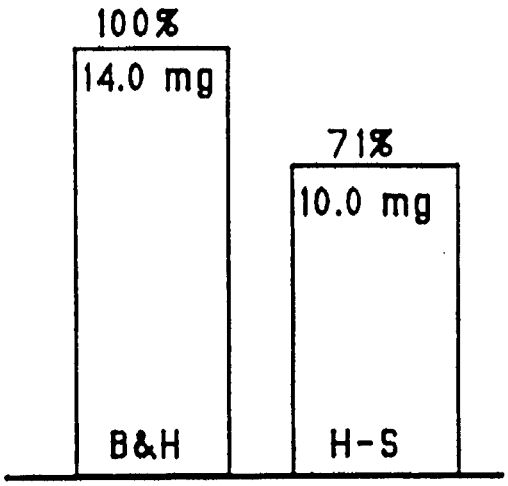

The applicants have found that the ability of a tobacco leaf to produce tobacco type flavour increases as the tobacco plant is ascended and that the ability to produce tar from such leaves also increases but to a much lesser degree. In particular, it has been found that the greatest flavour/tar ratio of the leaves of a tobacco plant is provided by the tips of the highest leaves.

The flavour produced by tobacco from such leaves, or the tips, generally is too high to be acceptable to a smoker in a conventional cigarette and hence the tobacco usually is blended with tobacco from the whole plant to provide an overall lower flavoured tobacco blend. The applicants have found that it is possible to employ such strongly flavoured tobacco and not only achieve a flavour level comparable to that of popular brands, but thereby deliver a much lower level of tar, consistent with the higher flavour/tar ratio of smoke produced by such tobacco. Alternatively, a higher flavour level may be provided but at a lower or the same tar level, as required.

There is described in copending U.S. patent Ser. No. 687,742 filed Apr. 19, 1991, assigned to the assignees hereof and the disclosure of which is incorporated herein by reference, (EPO publication No. 453,299), the use of non-absorbent microfine fibers in tubular form to achieve high levels of filtration. Such microfine fibers may be used herein to decrease the flavour level produced by the tobacco. As described therein, the microfine fibers in the cylinder thereof generally each has a diameter of about 0.5 to 10 microns. The cylinder of such fibers generally has a thickness of about 0.05 to about 4 mm and a density of about 0.05 to about 0.3 g/cc.

The smoke aerosol passing in contact with such filter material impinges on the non-absorbent fibers to cause tar particles to wet and adhere to the surface of the fibers as well as aqueous droplets of flavour components.

The elongate cylinder of microfine fibers preferably is arranged so that all the tobacco smoke passing through the filter containing the microfine fibers cylinder is directed through the cylinder wall. This result may be achieved by providing an outer annulus of high density conventional acetate filter tow material surrounding the microfine fiber cylinder, which in turn surrounds an inner core. A baffle, or other tobacco flow path directing means, is provided at the upstream end to direct tobacco smoke from the cigarette only into the high density material. This filter structure is described in copending U.S. patent application Ser. No. 752,595, filed Oct. 31, 1991, assigned to the assignees hereof and the disclosure of which is incorporated herein by reference, (PCT publication No. WO 90/09741).

As described therein, the microfine fiber cylinder is a highly efficient filtration medium but rapidly becomes clogged, so that the tobacco smoke must traverse an increasingly longer path through the outer annulus of conventional tow material and is filtered thereby before passing through the wall of the cylinder of microfine fibers into an inner axial cigarette smoke flow path leading to the downstream end of the filter element. In this way, the filter achieves a greater degree of filtration of the tobacco smoke as smoking proceeds and hence tends to counteract the increasing level of flavour and tar delivery which results as smoking progresses, so that a more uniform flavour delivery to the smoker is achieved.

Also as described in such application, the axial tobacco flow path provided radially inwardly of the cylinder of microfine fibers may be filled with low flow resistance acetate material, which may be crimped against tobacco smoke flow at the upstream end. Alternatively, tobacco flow into the axial flow path may be presented by crimping of the upstream end of the cylinder of microfine fibers.

In an alternative structure, the axial cigarette smoke path radially inwardly of the elongate cylinder of microfine fibers may be provided by an elongate plastic tube having a star-shaped cross section, so as to define a plurality of flow paths radially inwardly of the cylinder of microfine fibers through which cigarette smoke may flow longitudinally of cigarette.

The effect of the filtration efficiency between the first and last puffs of smoke can be increased further by providing an opening or openings through the cylinder of microfine fibers at or adjacent the upstream end thereof extending between the outer annulus of conventional tow material and the axial flow path, so that a substantial portion of the first puff of cigarette smoke travels only a short distance through the high efficiency tow and then enters the axial flow path preferentially through the openings, thereby by-passing travel through the microfine fibers. The access of the smoke to these openings is diminished as the cigarette is smoked, due to the collection of tar in the high efficiency tow adjacent the openings. By providing this modified form of the filter of our aforementioned U.S. patent application Ser. No. 752,595, very little filtration of tobacco smoke occurs in the first puff of cigarette smoke while the last puff of cigarette smoke has filtration both by a long distance of high efficiency tow and by the microfine fibers when the smoke is able to pass therethrough.

This modified form of filter element, having one or more openings through the cylinder of microfine fibers adjacent the upstream end of the cylinder, constitutes a novel filter structure provided in accordance with an aspect of the invention. Accordingly, in this aspect of the invention, there is provided a cigarette smoke filter element, which comprises an outer elongate cylinder of tobacco smoke filter material; an inner elongate cylinder of microfine fibers; an axial cigarette smoke path located radially inwardly of the cylinder of microfine fibers; the outer cylinder of smoke filter material having a greater resistance to the flow of cigarette smoke therethrough than the axial flow path; the cylinder having at least one opening therethrough adjacent the upstream end of the filter element to permit preferential passage of cigarette smoke from the outer cylinder through the at least one opening to the axial flow path during initial smoking of a cigarette to which the filter element is attached; and tobacco smoke flow path directing means located at the upstream end of the filter element in the intended direction of flow of cigarette smoke thereto for directing cigarette smoke from a cigarette to which the filter element is attached, only into the outer cylinder of tobacco smoke filter material.

In an alternative arrangement, the conventional high density tow material may be provided at the core of the filter element, with the low density tow or no tow at all being provided as the outer annulus. A baffle or other smoke path directing means again is provided to direct smoke, this time into the central core. Such filter element constitutes a further aspect of the invention. Accordingly, the present invention, in a further aspect, provides a cigarette smoke filter element, comprising an elongate plug of tobacco smoke filter material; an elongate cylinder of non-absorbent microfine fibers provided on the elongate plug and having a lesser resistance to the flow of cigarette smoke radially therethrough than longitudinally through the elongate plug; an axially-directed annular tobacco smoke flow path located radially outwardly of the elongate cylinder having a lesser resistance to the flow of cigarette smoke longitudinally therein than longitudinally through the elongate plug; and tobacco smoke flow path directing means located at the upstream end of the filter element in the intended direction of flow of cigarette smoke thereto for directing cigarette smoke from a cigarette to which the filter element is attached only into the elongate plug of tobacco filter material.

In this novel filter arrangement, ventilation holes may be provided in the filter wrapper closer to downstream end of the filter than is normal to improve CO dispersion of carbon monoxide (CO). In general, ventilation decreases the CO content of the smoke entering the smoker's mouth.

The higher-than-normal flavour/tar ratio tobacco which is used herein produces a higher-than-normal flavour level in the tobacco smoke from a burning cigarette containing the same. However, by using the cylinder of microfine fibers, the flavour level of tobacco reaching the smoker's mouth from the burning cigarette is decreased to conventional levels. However, since the tobacco produces a higher-than-normal flavour-to-tar ratio smoke, this same ratio may be retained when the smoke reaches the smoker's mouth, so that a significantly lower tar delivery results while the same flavour level is achieved as in a conventional highly-flavoured brand of cigarette.

This result is achieved without the necessity for resorting to high pressure drop filtration or excessive ventilation, both of which are objectionable to a smoker, for the reasons outlined above and lead to a lower level of flavour delivery. The ability to provide a lower tar level for a particular flavour level to a smoker provides considerable versatility in achieving any desired combination of results.

The uniformity of delivery of the tobacco flavour to the smoker from a cigarette can be improved further by providing a greater proportion of more highly-flavoured tobacco towards the lighting end and a greater proportion of less highly-flavoured tobacco towards the filter end of the cigarette. As mentioned previously, the flavour strength produced by a cigarette increases as smoking progresses. By providing the greater proportion of less highly-flavoured tobacco towards the filter end of the cigarette, this effect tends to be counteracted.

A filler rod containing a combination of differently-flavoured tobacco may be provided in the manner described in U.S. Pat. No. 4,896,681, assigned to one of the assignees hereof and the disclosure of which is incorporated herein by reference. Alternatively, discrete segments of differently-flavoured tobacco may be employed in the filler rod.

It is preferred to employ the lesser flavoured blend in the form of expanded tobacco, since expanded tobacco exhibits a tendency to effect a greater degree of filtration of smoke components than non-expanded tobacco.

The present invention, therefore, provides a cigarette which exhibits a high sensory appeal while delivering a low level of tar to the smoker with a more uniform flavour delivery, by a combination of factors, as follows:

1. Use in the tobacco blend from which the cigarette is formed of higher-than-normal quantities of tobacco from the upper levels of the tobacco plant, preferably their tips, which provides an initial high flavour-to-tar ratio, which then is maintained in the smoke delivered to the smoker, but at an acceptable attenuated flavour level;
2. Use of latter puff manipulation to decrease the flavour level and tar produced by the latter puffs of smoking of the cigarette; and 3. Use of a flavour strength reset to attenuate the flavour strength of the smoke to the level desired by the smoker.

The latter puff manipulation with respect to the flavour and tar produced in the latter puffs of smoking the cigarette may be effected, as described above, by utilizing a smoke re-route filtration technique or by using lesser strength tobacco at the filter end, or preferably both. Flavour strength reset is achieved, as described above, by utilizing a cylinder of microfine fibers as a filter element, or by using lesser strength tobacco at the filter end or preferably by using expanded tobacco at the filter end, or preferably a combination thereof. Preferably, all these factors are employed, with the cylinder of microfine fibers being incorporated into a smoke re-route filter and a higher proportion of lesser-flavoured expanded tobacco being used at the filter end and a higher proportion of the higher-than-normal flavour tobacco, possessing the high flavour-to-tar ratio, being used at the lighting end.

DESCRIPTION OF PREFERRED EMBODIMENT

Figure 4:
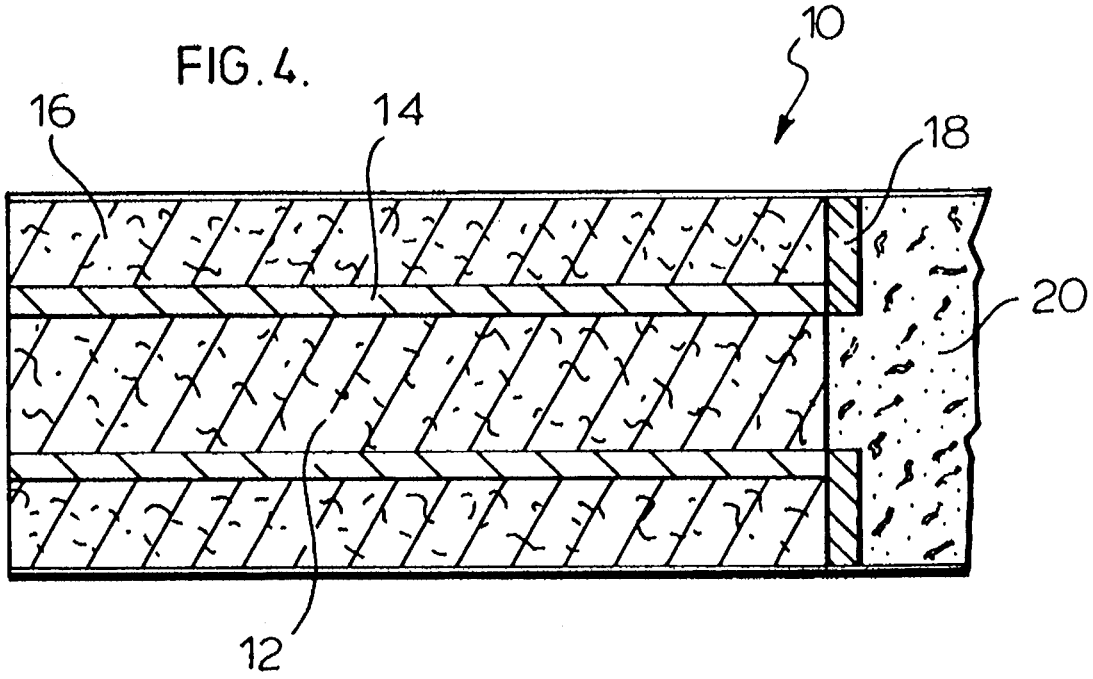

FIG. 4 is a schematic sectional view of a cigarette smoke filter element 10 comprising elongate plug 12 of tobacco smoke filter material, an elongate cylinder 14 of non-absorbent microfine fibres provided on the elongate plug 12 and an axially-directed annular tobacco smoke filter material 16. The elongate cylinder 14 of non-absorbent microfine fibres has a lesser resistance to the flow of cigarette smoke radially therethrough than longitudinally through the elongate plug 12 while the annular filter material 16 has a lesser resistance to the flow of tobacco smoke longitudinally therethrough than longitudinally through the elongate plug. An annular baffle 18 is provided at the upstream end of the filter element 10 for directing cigarette smoke from a cigarette 20 to which the filter element 10 is attached only into the elongate plug 12.

EXAMPLES

Example 1

A blind smoking test was carried out, wherein a cigarette constructed in accordance with the principles of the present invention was smoked and compared to a standard popular cigarette brand in Canada (Benson & Hedges 100s).

The cigarette of the invention was perceived to be flavourful, higher in impact and effects, yielding a better-balanced, fuller and smoother smoke in the early puffS. Very little change was observed in the flavour, impact, irritation and flavour balance in the latter half of the cigarette. The cigarette of the invention was preferred generally over the standard brand.

Example 2

Smoking tests were carried out on the cigarette samples which were the subject of the smoking test in Example 1. Determinations were carried out for total tar, nicotine and CO at the same flavour strength.

The results are shown in bar graph form in FIG. 1, the Benson & Hedges cigarette being labelled "B&H" and the inventive cigarette being labelled "H-S". As can be seen, at the same flavour strength level, for the cigarette of the present invention, tar was decreased to 48% of the level of the standard cigarette from 14.0 mg to 6.7 mg, nicotine was decreased to 57% from 1.2 mg to 0.68 mg and CO was decreased to 71% from 14.0 mg to 10.0 mg.

Example 3

Smoking tests were carried out to explore the effect of various manipulations of a cigarette. The tar/puff values were plotted against puff number. The results obtained are plotted graphically in FIG. 2.

The standard Benson & Hedges 100s (B & H) cigarettes (plot 3) increased from an initial tar level of 0.5 mg to a last puff tar level of 1.8 mg for a total of 13.1 mg. Using highly flavoured tobacco only with a standard filter from a Benson & Hedges cigarette produced plot 5, where the tar increased from a 1.0 mg level for the first puff to 3.0 mg for the last puff, for a total tar delivery of 22.5 mg, over twice that delivered by the standard B & H blend.

The highly flavoured tobacco was provided as a segment at the lighting end of the cigarette and a segment of expanded tobacco was provided at the filter end. Again a standard B & H filter was used. Plot (4) was obtained for this cigarette. In this instance, the tar rose from an initial level of 0.9 mg to 1.9 mg for the latter puff, for a total tar delivery of 12.5 mg, well below that for the highly flavoured tobacco above. A comparison of plots (4) and (5) illustrates the significant improvement in tar delivery which is attainable using a segment of expanded tobacco at the filter end of the cigarette filler rod. Both plots (4) and (5) exhibit a significant dip in the tar delivery during the middle puffs. The reason for this is unknown but is generally a characteristic of all cigarettes to some degree.

The highly flavoured tobacco used to prepare plot (5) again was smoked, but with the standard B & H filter being replaced by a filter comprising a cylinder of microfine fibers. In this case, plot (2) shown an increase from 0.3 to 1.7 mg during smoking for a total tar deliveries of 10.1 mg, i.e. significantly below the B & H value. A comparison of plots (2) and (5) illustrates the significant effect that the replacement of the conventional filter by one containing a cylinder of microfine fibers has on the tar delivery.

Finally, in plot (1), there is shown the tar delivery from a cigarette having a filter containing a cylinder of microfine fibers and containing a segment of expanded tobacco at the filter end. The tar increased from 0.2 mg for the first puff to 0.9 mg at the last puff, for a total tar delivery of only 4.7 mg.

A comparison of plots (1) and (4) illustrates the effect on tar delivery of the utilization of a filter comprising a cylinder of microfine fibers in place of a conventional filter. A comparison of plots (1) and (3) illustrates the effect on the tar delivery of the utilization of a cigarette constructed according to the present invention in comparison to a standard cigarette delivering the same flavour level. It will also be seen that, not only is a lower puff-to-puff level of tar delivery and an overall significantly lower tar delivery achieved, but the curve is flatter in the case of the present invention, so that a more uniform delivery of tar and flavour is achieved.

Example 4

Figure 3:
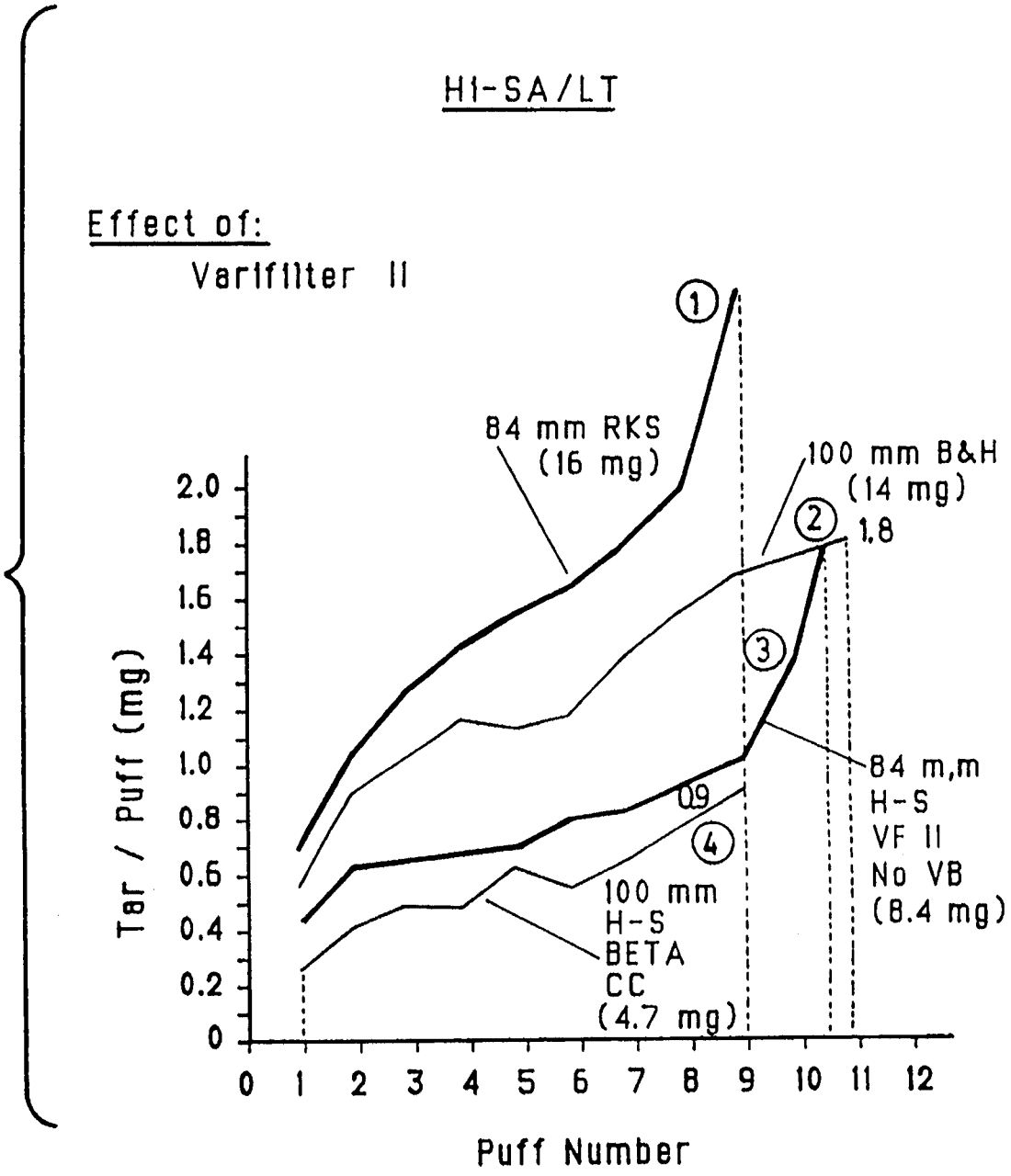
FIG. 3 is a graphical presentation of additional smoking test results.

Smoking tests were carried out to explore the effect of further manipulation of a cigarette. The tar/puff values were plotted against puff number. The results obtained are plotted graphically in FIG. 3.

Plots (1) and (3) compare the results obtained with an 84 mm Rothmans King Size ("RKS") cigarette as manufactured in Canada delivering a total of 16 mg of tar with a cigarette using a highly flavoured blend and a filter containing a cylinder of microfine fibers with openings through the cylinder at the upstream end (plot 2).

Figure 2:
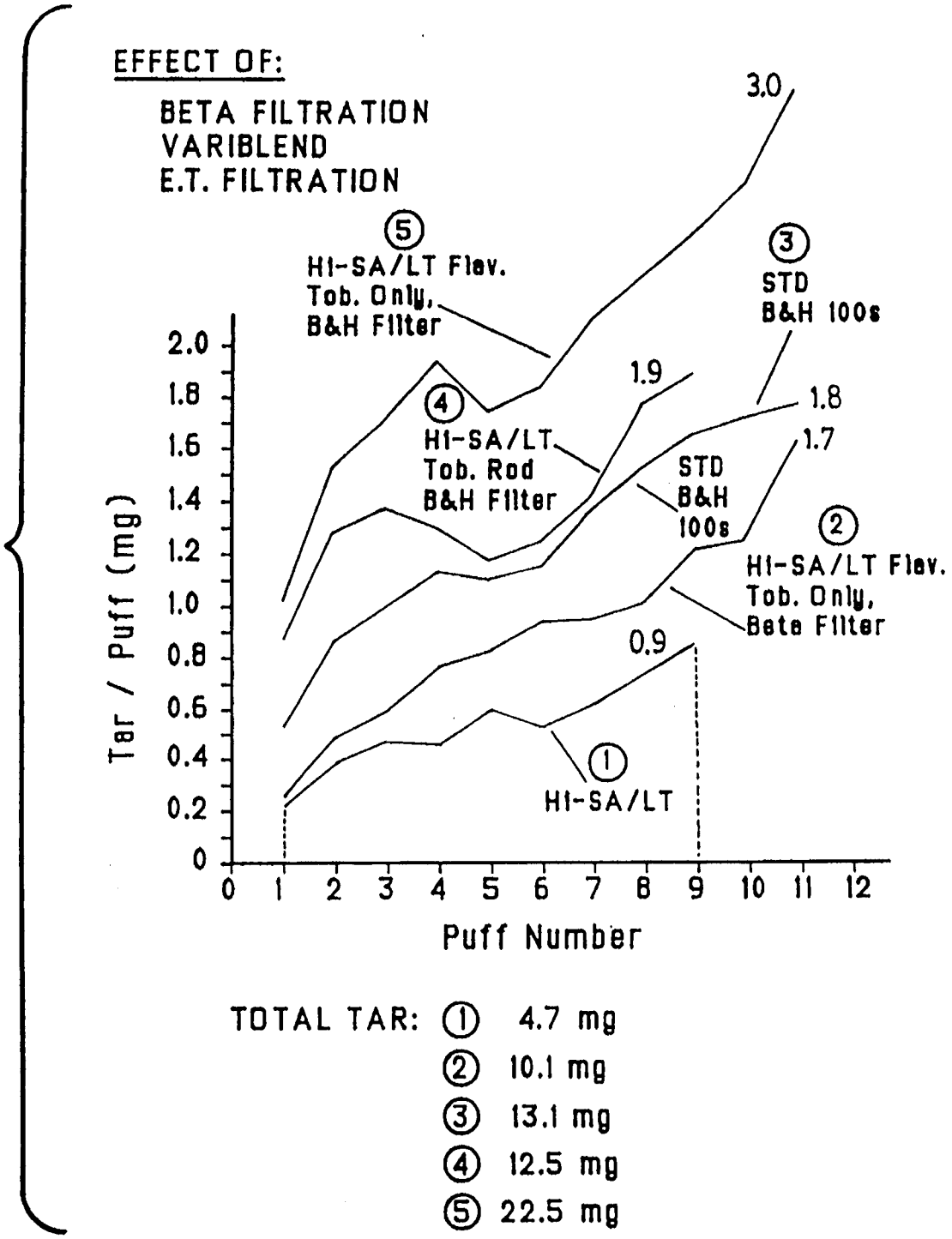
FIG. 2 is a graphical presentation of additional smoking test results.

A comparison of plot (1) with plot (3) shows that not only is a lower puff-to-puff level of tar delivery and an overall significantly lower tar delivery achieved, but the curve is flatter in the case of the present invention, so that a more uniform delivery of tar and flavour is achieved. For comparison, plots (1) and (3) of FIG. 2 are repeated in FIG. 3 as plots (4) and (3) respectively.

SUMMARY OF DISCLOSURE

In summary of this disclosure, the present invention provides a novel cigarette construction which enables a full flavour smoke to be provided at a significantly decreased tar level. Modifications are possible within the scope of this invention.

What we claim is:

1. A cigarette smoke filler element, comprising:

an elongate plug of tobacco smoke filter material, an elongate cylinder of non-absorbent microfine fibers provided on said elongate plug and having a lesser resistance to the flow of cigarette smoke radially therethrough than longitudinally through said elongate plug, and an axially-directed annular tobacco smoke flow path located radially outwardly of said elongate cylinder, said axially-directed annular tobacco smoke path having a lesser resistance to the flow of cigarette smoke longitudinally therein than longitudinally through said elongate plug, and tobacco smoke flow path directing means located at the upstream end of said filter element in the intended direction of flow of cigarette smoke thereto for directing cigarette smoke from a cigarette to which the filter element is attached only into said elongate plug of tobacco filter material.

2. The filter element of claim 1, wherein the elongate plug of tobacco smoke filter material is conventional cellulose acetate tow filter material.

3. The filter element of claim 2, wherein said tobacco flow path directing means is provided by baffle means at said upstream end of said filter element.

4. The filter element of claim 2, wherein said annular cigarette smoke path is provided by a low flow resistance cellulose acetate material.

5. The filter element of claim 4 including an outer wrapper to said filter element, wherein a plurality of ventilation openings is provided through said outer wrapper in communication with said annular flow path to facilitate dispersion of carbon monoxide in cigarette smoke flowing in said annular flow path.

6. The filter element of claim 2 wherein at least one opening is provided through said elongate cylinder adjacent the upstream end of the filter element to permit preferential passage of cigarette smoke from said elongate plug through said at least one opening to said annular flow path during initial smoking of a cigarette to which the filter element is attached.

7. The filter element claimed in claim 10, wherein tobacco smoke flow path blocking means is located at the downstream end of the filter element to permit filtered tobacco smoke to pass only from the annular flow path.

8. The filter element of claim 1, wherein said microfine fibers in said cylinder thereof each has a diameter of about 0.5 to about 10 microns.

9. The filter element of claim 8, wherein said cylinder of said microfine fibers has a thickness of about 0.5 to about 4 mm and a density of about 0.05 to about 0.3 g/cc.

* * * * *